US007223036B2

(12) United States Patent
Chang

(10) Patent No.: US 7,223,036 B2
(45) Date of Patent: May 29, 2007

(54) AUTO LOADING AND AUTO DAMPENING CLEANING APPARATUS

(76) Inventor: Long Chang, 7 Wickland, Irvine, CA (US) 92620

( * ) Notice: Subject to any disclaimer, the term of this patent is extended or adjusted under 35 U.S.C. 154(b) by 0 days.

(21) Appl. No.: 10/792,754

(22) Filed: Mar. 5, 2004

(65) Prior Publication Data

US 2005/0196225 A1 Sep. 8, 2005

(51) Int. Cl.

| | |
|---|---|
| ***A46B 11/00*** | (2006.01) |
| ***A46B 11/04*** | (2006.01) |
| ***A47K 7/02*** | (2006.01) |
| ***A47L 13/46*** | (2006.01) |

(52) U.S. Cl. ..... 401/191; 401/270; 401/280; 401/290; 15/228; 15/231

(58) Field of Classification Search ..... 401/191, 401/270, 290, 280; 15/51, 99, 228, 231
See application file for complete search history.

(56) References Cited

U.S. PATENT DOCUMENTS

RE25,419 E * 7/1963 Evans ..... 15/99
3,916,470 A * 11/1975 May ..... 15/98
5,092,699 A * 3/1992 Silvenis ..... 401/21
6,741,054 B2 * 5/2004 Koselka et al. ..... 318/445
6,859,976 B2 * 3/2005 Plankenhorn ..... 15/380

* cited by examiner

*Primary Examiner*—David J. Walczak
(74) *Attorney, Agent, or Firm*—Cleveland R. Williams

(57) ABSTRACT

An auto loading and auto dampening cleaning apparatus which comprises a base sweeping pad, a fluid reservoir superimposed over said sweeping pad which defines a slit between the two, a handle having a fork shaped frame which is rotateably attached to the sweeping pad. A lower roll bar contains clean, cleaning material and an upper roll bar receives soiled cleaning material. First and second trigger mechanism activates the roll bars and fluid reservoir to advance the cleaning material and disperse cleaning solution onto the cleaning material on the lower roll bar passes through the slit defined by the fluid reservoir and sweeping pad around the bottom of the sweeping pad and up to the upper roll bar.

9 Claims, 4 Drawing Sheets

AUTO LOADING AND AUTO DAMPENING CLEANING APPARATUS

BACKGROUND OF THE INVENTION

1. Field of the Invention

The present invention relates to an auto loading and auto dampening cleaning apparatus for cleaning surfaces such as floors, walls, etc. which are soiled with dirt, dust or liquids. The cleaning apparatus contains a continuous sheet of cleaning material, a liquid reservoir for containing a cleaning solution, a mechanism for advancing the sheet of cleaning material and a mechanism for depositing cleaning solution on the cleaning material.

There are several notable advantages with the current invention. Namely, there is a time saving factor in replacing the soiled, cleaning material with clean, cleaning material. These materials are quickly and easily removed and replaced on the roll bars located on the cleaning apparatus.

The cleaning material, located on the cleaning apparatus does not produce any waste and it is utilized essentially 100 percent in use. The apparatus, additionally, contains a built-in on demand fluid reservoir for dampening cleaning material. The apparatus contains a rewind mechanism for rewinding soiled, cleaning material that can be either manually or motorized operated. Finally, the soiled cleaning material can be easily unloaded from the cleaning apparatus without contacting the soiled portion of the cleaning material.

2. Description of the Prior Art

Numerous devices exist for cleaning surfaces such as floors and the like. Surfaces such as floors are especially aesthetically pleasing and safe when they are clean, dry and dirt free. Floors and other surfaces typically become dirty due to environment contaminants such as dirt, dust and other debris. People, pets and machines account for depositing the above undesirable contaminants and liquids on surfaces through use, accidents and other methods.

These and other surface cleaning problems have been addressed by the prior art. For example U.S. Pat. No. 4,550,467 to Johnson et al., relates to a "Bowling Lane Duster" or cleaning apparatus suitable for removing dust from a bowling lane which includes a rigid frame having a transversely disposal spacer bar with a foam padded bar disposed beneath the spacer bar. Cloth roller bars work in conjunction with the padded bar to provide exposure of cloth fabric to the bowling lane surface or floor.

U.S. Pat. No. 5,092,699 to Silvenius, entitled "Floor Cleaning Using Index Fabric Rolls In Removable Cassette", describes a floor cleaning apparatus which utilizes indexing fabric rolls to provide a cleaning surface. The rolls are contained within a replaceable cassette unit. The cassette is mounted within a housing which is attached to an elongated handle.

U.S. Pat. No. 5,203,047 to Lynn, entitled "Cleaning Apparatus With Rotatable Endless Belt" describes a surface cleaning head having a frame supporting a rotatable belt for absorbing liquid and contaminants from a soiled surface.

The cleaning apparatus has a surface cleaning head having a frame supporting a rotatable belt for absorbing liquid and contaminants from a soiled surface, a mechanism for conveying the rotatable belt and for removing contaminants from the belt and storage device for storing the liquid and contaminants removed from the rotatable belt.

U.S. Pat. No. 5,327,609 to Bierma et al., entitled "Mop Sweeping Apparatus With Continuous Action" relates to a mop sweeping apparatus which has a housing adapted to move over a surface to be cleaned. A cooperating pair of rollers is contained by the housing and consists of a first roller having a dust gathering cloth wound thereon and a second roller on which the cloth is windable. The rollers are driven by a motor for winding the cloth on the first roller to the second roller. A pressing surface consisting of two rollers under which the cloth is retained is provided.

U.S. Pat. No. 5,542,143 to Jem-Yuan, entitled "Circular Cleaning Swab Structure" teaches a circular cleaning swab structure consisting of a grip stem, a casing and an annular water-absorbing member. The casing is connected to the lower end of a grip stem and has an upper cover secured on an upper opening of the case by fasteners which defines an interior water containing chamber.

The water-absorbing member is contained within a clearance defined absorbing member is located under a bottom of the casing for contracting the ground. Engaging teeth on the absorbing member engage with corresponding teeth of a rotary wheel rotatably disposed on an outer lateral side of the casing.

Finally, U.S. Pat. No. 6,298,517B1 Patented Oct. 9, 2001 to McKay, entitled "Cleaning Tool With Removable Cleaning Sheets" describes a mop for cleaning a surface area such as a floor. The mop includes a handle and a mop head which is connected to handle. The mop head has a top surface and a bottom surface. Multiple cleaning sheets are each removably supported on the bottom surface in a stacked configuration. Each of the sheets has an outward face for cleaning and an inward surface.

When the outward face of the outermost sheet becomes soiled due to cleaning action, the sheet may be peeled away to expose a non-soiled sheet. The cleaning sheets include a bibulous layer and a moisture barrier layer which is utilized to prevent transport of liquid from one bibulous layer to the other.

As can readily be determined from the foregoing, there is an ongoing research effort to produce new cleaning surfaces such as floors and the like.

SUMMARY OF THE INVENTION

The present invention resides in an auto loading and auto dampening cleaning apparatus, which is suitable for cleaning surfaces such as floors. The cleaning apparatus comprises a sweeping pad having an elongated rectangular configuration. A fluid solution tank is superimposed over the top of the sweeping pad and connects to the top of said sweeping in a manner that defines a slit between the two.

A handle having a fork shaped frame is rotatably attached to the sweeping pad near the mid-section thereof. The forked portion of the frame contains an upper rewind roll bar which has an elongated circular configuration with rotation means and rewind means. A lower unwind roll bar which has an elongated circular configuration connects to the forked portion of the frame with rotation means. A first roll guard is located between the upper roll bar and the lower roll bar. A second roll guard is located behind the upper roll bar. The upper portion of the fork shaped frame is an elongated circular shaft that contains a first trigger means for activating the rewind roll bar. In use, a clean-cleaning material is attached to the lower unwind roll bar, threaded through the slit between the solution tank and the sweeping pad, pulled around the back portion of a roll guard and attached to the rewind roll guard. The first trigger means activates the fluid solution tank or reservoir and dispenses the cleaning solution onto the unsoiled cleaning material. The second trigger means advances the saturated cleaning material to the bottom portion of the cleaning pad. The second trigger means causes the cleaning material to unwind on the first control bar. The cleaning apparatus is pushed along the surface to be cleaned. The above steps are repeated until the soiled surface is cleaned.

BRIEF DESCRIPTION OF THE DRAWINGS

This invention will be better understood when consideration is given to the below-described drawings in which the corresponding reference numbers refer to the same elements throughout the drawings.

DETAILED DESCRIPTION OF THE INVENTION

Figure 1:
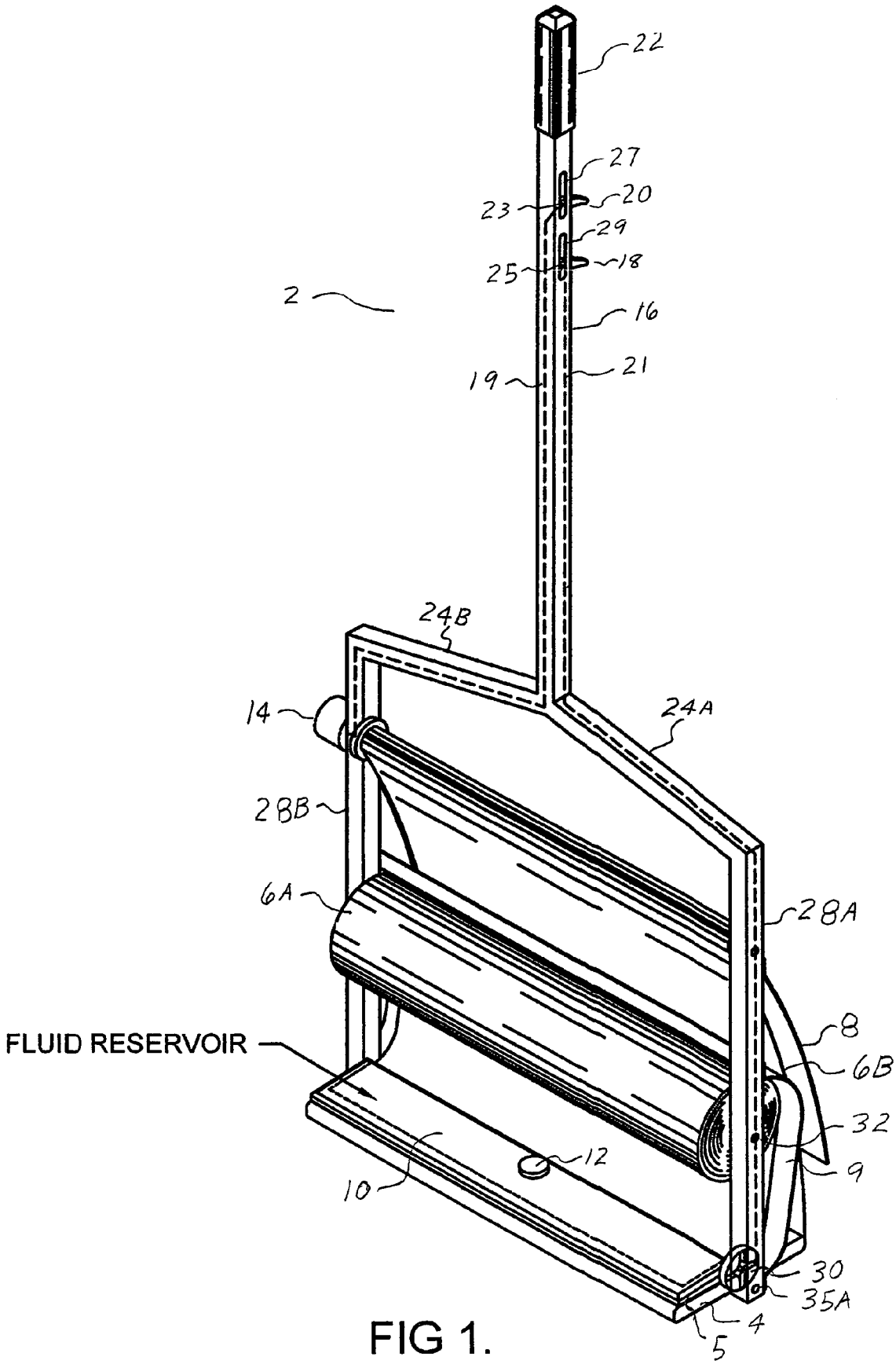
FIG. 1 is a front perspective drawing of the cleaning apparatus.

This invention relates to an auto-loading and auto-dampening cleaning device wherein the cleaning device or apparatus (2) comprises a sweeping pad (4), which has an elongated, rectangular configuration. Sweeping pad (4) is preferably constructed from soft pressable rubber or plastic to maintain pressure against a surface during cleaning. A fork shaped handle (16) is rectangular in configuration and contains right fork (24A) and left fork (24B). Lower fork shafts (28A) and (28B) rotatably attach to opposite sides of sweeping pad (4) with pins (35A). Cleaning material (6A) is wrapped around roll bar (32) and attaches to right (28A) and left (28b) lower fork shafts of the fork shaped handle (16). Fluid reservoir (10) contains fill cap (12) and is superimposed over the top of sweeping pad (4), which is rectangular in configuration. Clean, cleaning material (6A) is threaded under fluid reservoir (10) through slit (5) and over and around sweeping pad (4). Soiled cleaning material (6B) is wound around roll bar (33). Roll guard (9) separates clean, cleaning material (6A) from soiled cleaning material (6B) and prevents them from contacting each other.

Upper fork shaped handle (16) is an elongated rectangular shaped shaft and has first slot (27), which contains trigger (20) that connects to first roll bar mechanism (14) via cable (19). First rewind bar mechanism (14) is attached to upper rewind roll bar (33). Second slot (29) located in the upper portion of handle (16) contains trigger (18) which connects to cam (30) located on the fluid reservoir (10) via cable (21). Trigger (18) opens and closes the lid, not shown, of fluid reservoir (10). Pins (23) and (25) hold triggers (20) and (18) in place in slots (27) and (29). Handle grip (22) is located at the top of upper handle (16) and is used to maintain a firm grip on said handle (16) by a user.

Figure 2:
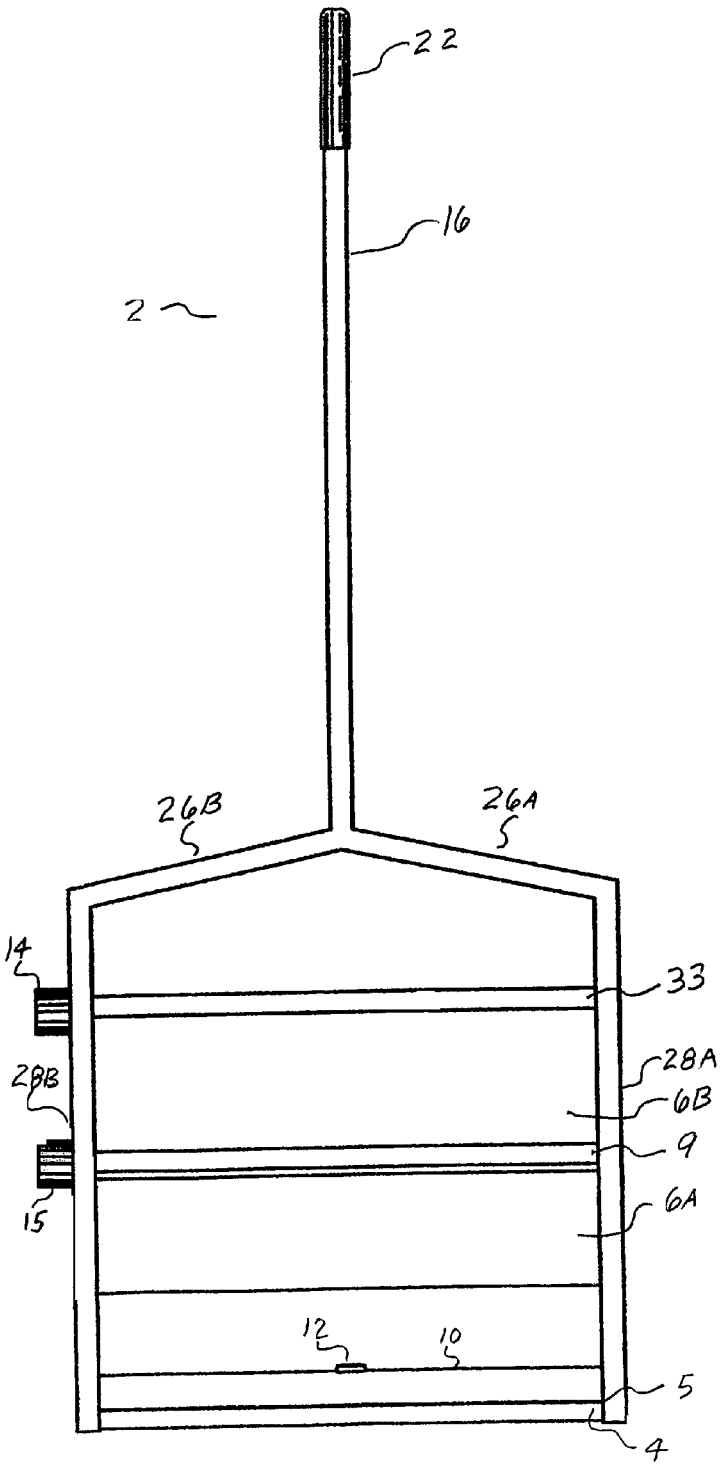
FIG. 2 is a front view of the cleaning apparatus shown in FIG. 1.

FIG. 2 is a front view of the cleaning apparatus (2) of FIG. I which show fork shaped handle (16). Right and left upper fork shaped shafts (26A) and (26B) are slanted downward from upper handle (16) to right and left lower fork shafts (28A) and (28B). Rewind mechanism (14) is attached to upper roll bar (33) wherein clean, cleaning material (6A) is wrapped around roll bar (32), not shown. Fluid reservoir (10) with filling cap (12), which is superimposed over sweeping pad (4) and defines slit (5) which is located between the two. Unwind mechanism (15) is attached to and supplies bias to lower roll bar (33) to prevent cleaning material (6A) from sagging or unwinding prematurely.

Figure 3:
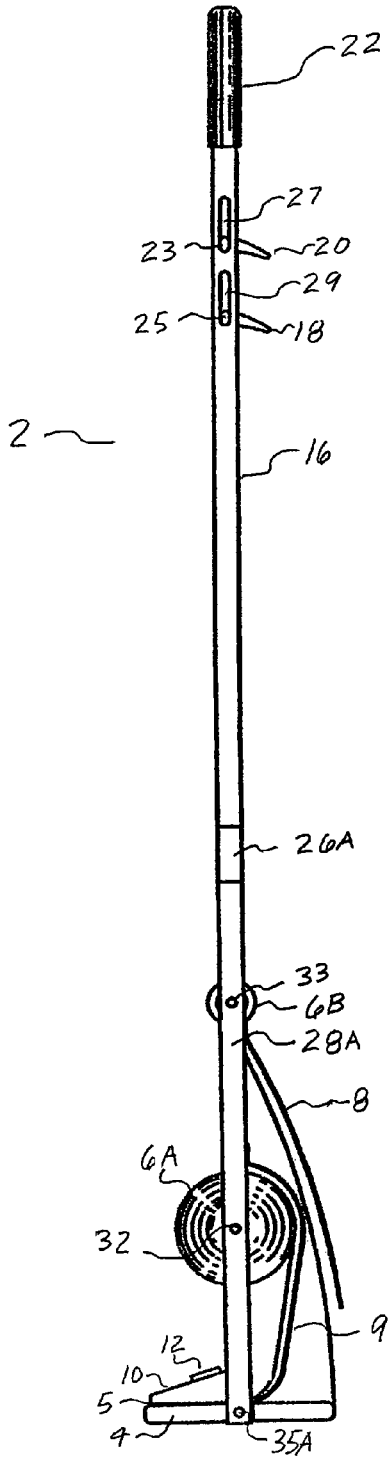
FIG. 3 is a side drawing of the cleaning apparatus shown in FIG. 1

FIG. 3 is a side view of FIG.2 wherein cleaning apparatus (2)is shown with upper fork shaped handle (16) which shows handle grip (22) and first trigger (20) which is held in slot (27) by pin (23). Second trigger (18) is held in slot (29) by pin (25). Right upper fork shaft (26A) attaches at a slant to lower fork shaft (28A). Left upper fork shaft (26B) attaches at a slant to lower fork shaft (28B).

Upper roll bar (33) contains soiled, cleaning material (6B). Lower roll bar (32) contains clean, cleaning material (6A), which is threaded under fluid reservoir (10) containing refill cap (12) and over sweeping pad (4) through slit (5). First roll guard (9) is rectangular in configuration near the top portion of the fork shaped shaft and is circular in configuration near the mid-section thereof to fit around clean, cleaning material (6A). An second roll guard (8) is located in back of soiled, cleaning material (6B) to prevent a user from coming into contact with soiled cleaning material.

Figure 4:
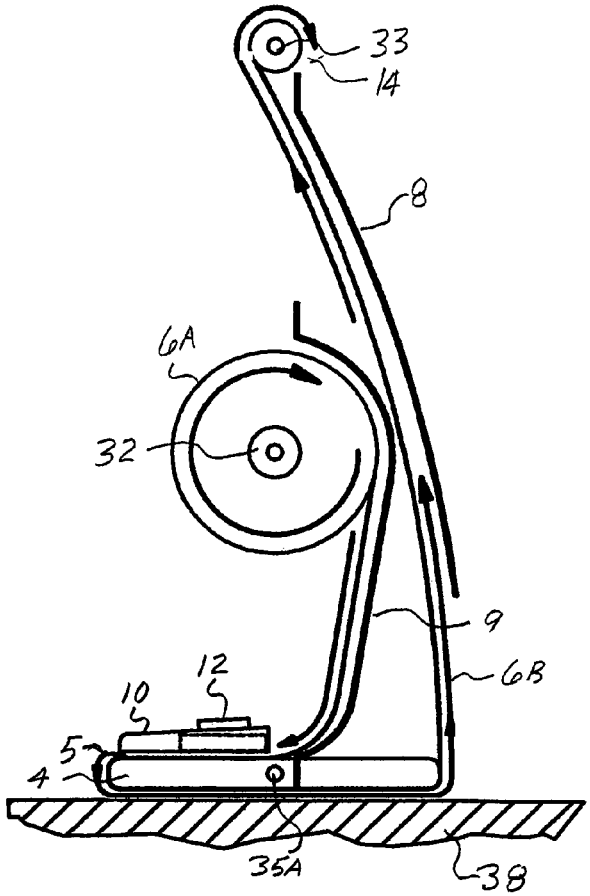
FIG. 4 is a side partial view of the cleaning material solution reservoir, sweeping pad, and cleaning material shield.

FIG. 4 is a partial view of FIG. 3, which shows the route traveled by cleaning material (6A) throughout the cleaning process and retention of soiled cleaning material (6B). Clean, cleaning material (6A) is wound around roll bar (32) and rotates in a clockwise direction through slit (5) which is located between the bottom of fluid reservoir (10) and top of sweeping pad (4). Cleaning material (6A) travels along the bottom of sweeping pad (4) and contacts the top of soiled surface (38). It is to be noted that cleaning material (6A) can be constructed from cloth, paper and other conventional materials used to clean surfaces, so long as the cleaning materials (6A) is able to absorb cleaning fluid from fluid reservoir (4).

Figure 5:
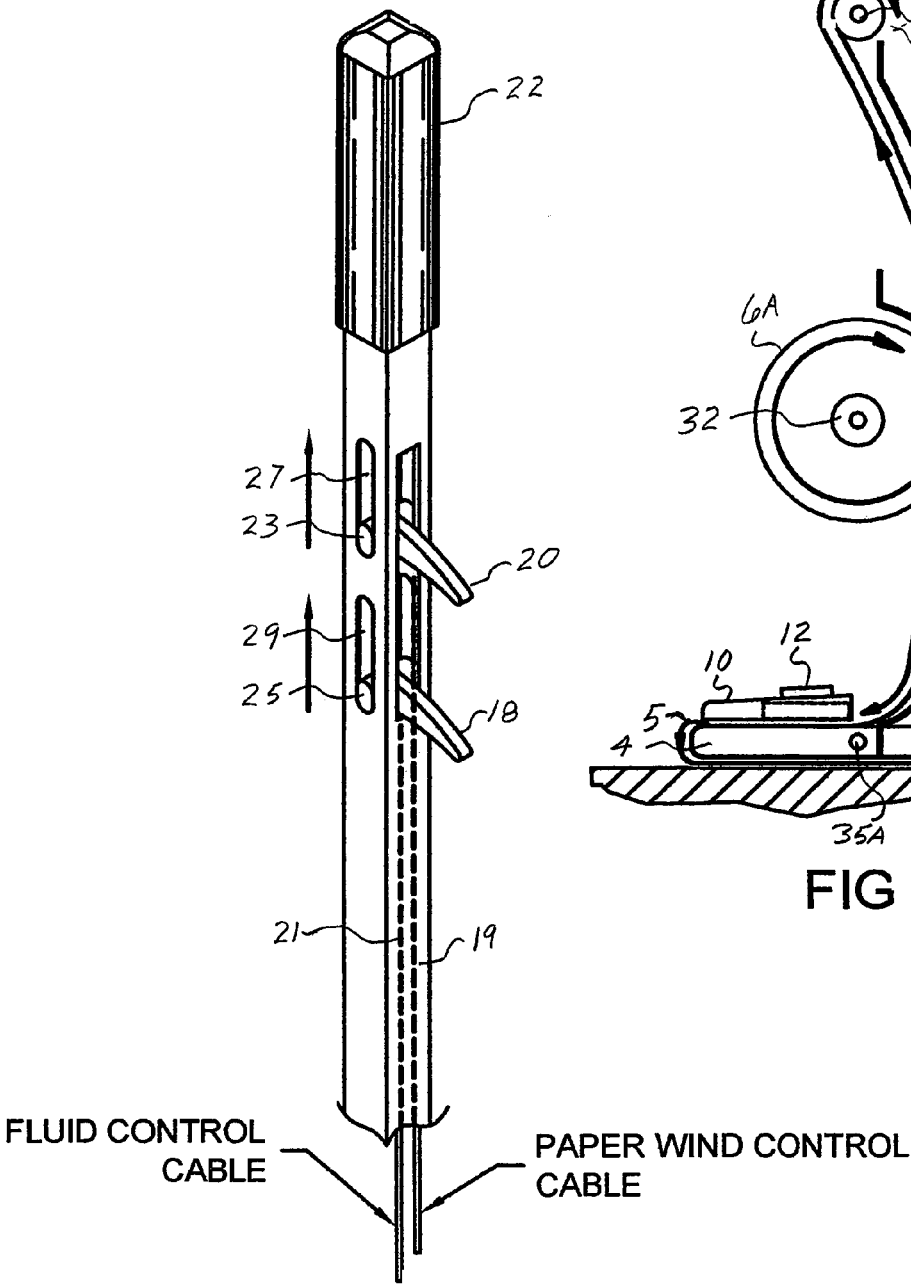
FIG. 5 is a cut-away view of the upper portion of the fork shaped handle.

FIG. 5 is a cut-away view of the upper handle (16) of the forked shaped handle which shows handle grip (22) and slot (27), which contains first trigger (20) and pin (23). First trigger (20) is attached to cable (19) which controls paper wind control mechanism (14), not shown. Second trigger (18) is held in place in slot (29) and is connected to fluid control cable (21) which controls the amount of fluid released from fluid reservoir (10), not shown, onto cleaning material (6A), not shown.

Figure 6:
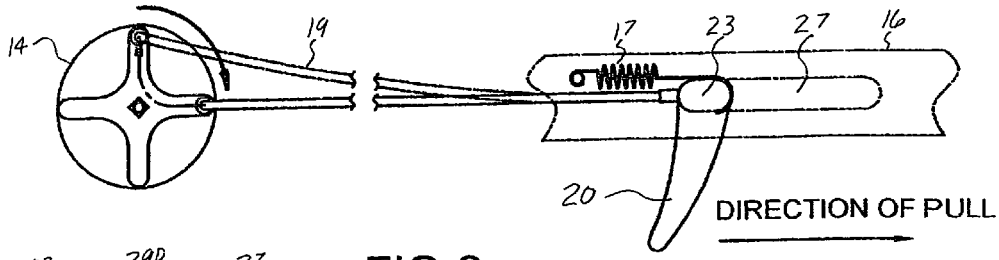
FIG. 6 is a partial cut-away view of the trigger mechanisms.

FIG. 6 is a partial, cut-away view of first trigger (20) and rotation mechanism (14) wherein first trigger (20) is held in place in slot (27) by pin (23). Spring (17) applies bias against trigger (20) when it is pulled and causes cable (19) to rotate winding mechanism (14) ninety degrees, thus winding roll bar (33) and unwind roll bar (32), which pulls cleaning material (6A) around sweeping pad (4). It is to be noted that second trigger (18) works substantially the same as first trigger (20) except that it rotates cam (30).

Figure 7:
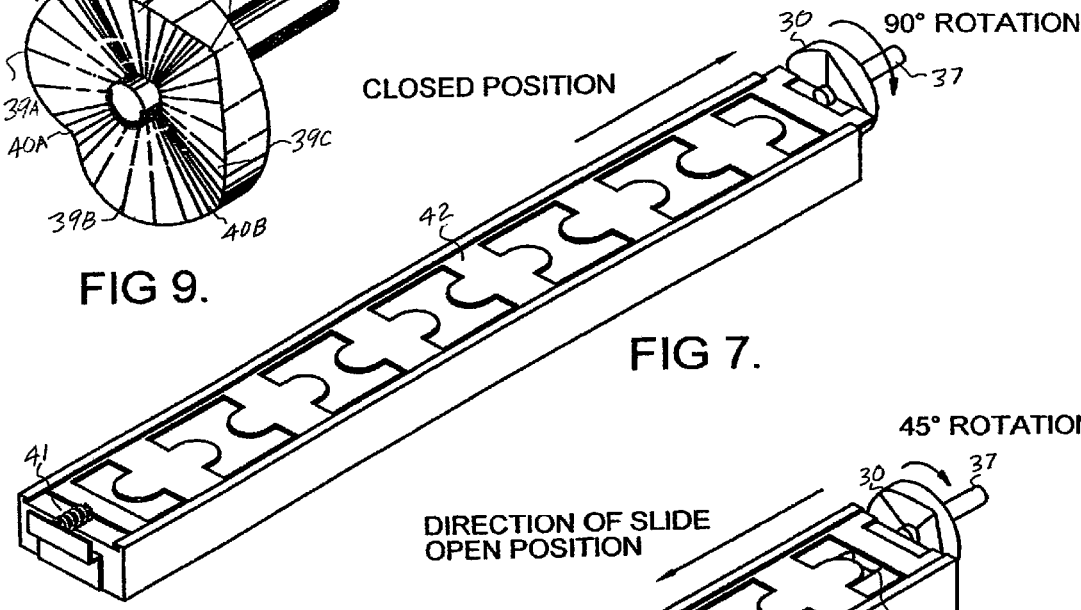
FIG. 7 is an inverted view of the reservoir lid in the closed position.
Figure 8:
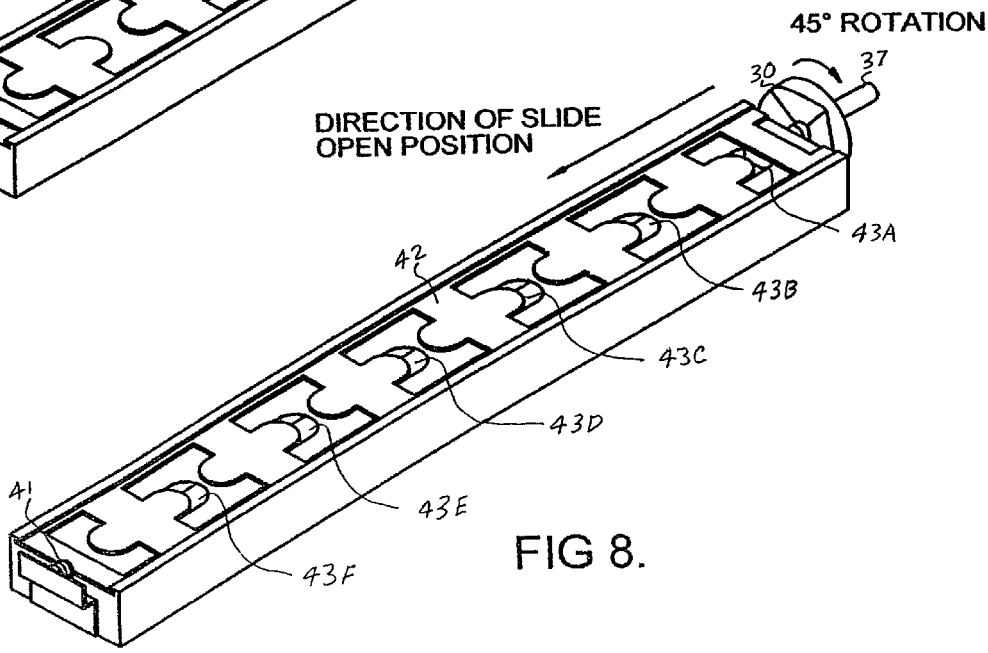
FIG. 8 is an inverted view of the reservoir lid in the open position.

FIGS 7 and 8 are inverted views of lid (11) which is in the closed position FIG. 7 and the open position FIG. 8 Cam (30) is rotated by second trigger (18) ninety degrees to close lid (11) and forty five degrees to open lid (11). Cam (30) is connected to shaft (37) which allows cam (30) to rotate when activate. Lid (11) contains spring (41) to apply bias to sealing mechanism (42) which in the open position allows fluid to pass through openings (43A to 43F) and when in the closed position seals openings (42A to 43F).

Figure 9:
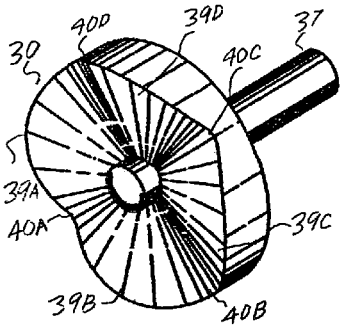
FIG. 9 is a cut-away view of the cam mechanism used to open and close the reservoir lid.

FIG. 9 is a cut-away view of cam (30) which shows peaks (39A to 39D) and valleys (40A to 40D). When cam (30) is in the peak position it pushes against lid (11), not shown, and exposes openings (43A to 43F). When cam (30) is in the valley position spring (41), not shown, pushes lid (11), not shown, into the closed position.

Obviously, many modifications and variations of the invention, as hereinbefore set forth may be made without departing from the spirit and scope thereof, and therefore only such limitations should be imposed as are indicated in the appended claims.

I claim:

1. An auto loading and auto dampening cleaning apparatus which comprises a sweeping pad which has an elongated rectangular configuration, a fluid solution reservoir that is superimposed over the top of the sweeping pad which defines a slit between the two, a handle having a fork shape rotatably attached to the sweeping pad, wherein said handle contains an upper roll bar and a lower roll bar and first and second trigger means for activating the roll bars and fluid solution reservoir, and wherein the lower roll bar contains clean, cleaning material wrapped around it and said clean, cleaning material passes through the slit defined by the fluid solution reservoir and the sweeping pad, around said sweeping pad and up to the upper roll bar where it wrapably attaches thereto.

2. The auto loading and auto dampening cleaning apparatus of claim 1, wherein the first trigger means comprises a first trigger having spring bias means attached to a cable which is attached to a first roll bar mechanism located on the upper roll bar, wherein the first roll bar mechanism is rotated ninety degrees when activated.

3. The auto loading and auto dampening cleaning apparatus of claim 1, wherein the fluid solution reservoir contains a refill cap.

4. The auto loading and auto dampening cleaning apparatus of claim 1, wherein the fluid solution reservoir contains a lid located on the bottom of the reservoir for dispensing cleaning solution onto the cleaning material.

5. The auto loading and auto dampening cleaning apparatus of claim 4, where in the lid is attached to a cam mechanism.

6. The auto loading and auto dampening cleaning apparatus of claim 1, wherein the second trigger means has spring bias means and is attached to a cable, which is attached to a cam.

7. The auto loading and auto dampening cleaning apparatus of claim 6 where the cam is circular in configuration and is defined by peaks and valleys on it's inside surface area.

8. The auto loading and auto dampening cleaning apparatus of claim 6, wherein the second trigger means activates the cam by rotating it to either open or close a lid located on the bottom of the fluid solution reservoir.

9. The auto loading and auto dampening cleaning apparatus of claim 1, wherein the handle having a fork shaped frame contains first and second roll guards.

* * * * *